United States Patent [19]

Hippach

[11] 4,139,178

[45] Feb. 13, 1979

[54] HOIST APPARATUS

[75] Inventor: Wilburn L. Hippach, West Covina, Calif.

[73] Assignee: Power Climber Inc., Calif.

[21] Appl. No.: 835,684

[22] Filed: Sep. 22, 1977

[51] Int. Cl.[2] ..... B66D 1/76

[52] U.S. Cl. ..... 254/175.5; 187/20; 254/191

[58] Field of Search ..... 254/175.5, 175.7, 191, 254/167, 168, 149; 187/17, 20

[56] References Cited

U.S. PATENT DOCUMENTS

| | | | |
|---|---|---|---|
| 3,100,626 | 8/1963 | Good | 254/175.5 |
| 3,231,240 | 1/1966 | Warto | 254/191 |
| 3,520,515 | 7/1970 | Pomagalski et al. | 254/175.5 |
| 3,524,626 | 8/1970 | Pomagalski et al. | 254/175.5 |
| 3,729,173 | 4/1973 | Levardon | 254/175.5 |
| 3,944,185 | 3/1976 | Evans | 254/175.5 |
| 3,949,969 | 4/1976 | Kaufer | 254/175.7 |

*Primary Examiner*—Lawrence J. Oresky
*Attorney, Agent, or Firm*—Romney, Schaap, Golant, Scillieri, Disner & Ashen

[57] ABSTRACT

An improved cable hoist apparatus having a drive sheave, a tensioning sheave, a pressure inducing chain and a brake system including a set of gears, linkage and brake actuating means. The linkage includes means for disengaging the gears under extreme operating conditions without loosening the chain from around the cable. An improved shaft assembly prevents binding and a solenoid actuated primary brake is manually operated.

4 Claims, 5 Drawing Figures

HOIST APPARATUS

BACKGROUND OF THE INVENTION

1. Field of the Invention

The present invention relates to a hoist apparatus for raising or lowering a load along a cable and more particularly to an improved hoist apparatus which is simply constructed, relatively inexpensive and highly reliable.

2. Description of the Prior Art

The present invention is an improvement over the apparatus disclosed in U.S. Pat. No. 3,944,185 as well as all of the patents cited therein: U.S. Pat. Nos. 3,729,173; 3,721,426; 3,524,626; 3,520,515; 3,231,240; and 3,100,626. The apparatus disclosed in the 3,944,185 patent is, in brief a hoist apparatus including a motor, a power transmission, a cable driving sheave, a cable tensioning sheave, a pressure exerting chain, a diverter block, linkage and gears to transfer rotation from the tensioning sheave to a brake mechanism while at the same time allowing the tensioning sheave to pivot.

A problem has developed with this apparatus in relation to the cable becoming jammed at the diverter block after the cable has passed around the driving sheave. This occurs when the end of the cable abuts the diverter block, unravels and expands outwardly, a phenomenon commonly referred to as "bird caging". Not only is there damage to the cable, but more importantly, time is lost by an operator who must open the hoist apparatus, remove the damaged cable and then rethread the cable through the apparatus by hand. Of course while this occurs, the operator's equipment is idle and the operator is spending time on nonproductive work.

Another problem related to the accident prevention mechanism centering about the linkage and the gears. The linkage and the gears are present to transmit rotational motion from the tensioning sheave to a cam which acts as an emergency brake upon the cable. For example, if the apparatus begins to fall, the rotation of the tensioning sheave will accelerate. This acceleration is transmitted through the gears to a mechanism which actuates the cam. The gears are connected to the linkage in order to allow the tensioning sheave to pivot and yet still maintain the gears in operable contact. When the velocity of the gears suddenly increase, forces are generated which tend to rotate the linkage into an overcenter position causing the gears to bind. In addition, excessive forces are also placed upon the shafts on which the gears are mounted, again causing binding. Once again, these problems necessitated the time of an operator to correct as well as time for replacing any damaged parts.

Further problems have also been noticed which have detracted from the effective operation of the hoist.

SUMMARY OF THE INVENTION

The above problems have been recognized and solved by the apparatus disclosed herein which provides for an improved hoist apparatus for moving along a cable comprising a housing; a first disclike member mounted to said housing and having a circumferential peripheral groove for receiving a cable; a first link having first and second arms in a generally L-shape, said link being pivotally connected to said housing where the two arms merge; a second disclike member rotatably mounted to said first link at a middle portion of said first arm for allowing said second disclike member to pivot toward and away from said first disclike member, said second disclike member having a circumferential peripheral groove in planer alignment with the periphery of said first disclike member; roller means having peripheral grooves disposed adjacent said second disclike member for directing said cable away from said first disclike member and then out of said housing; pressure applying means disposed about said first disclike member for biasing said cable toward the peripheral groove of said first member, said pressure applying means having first and second end portions, said first end portion being connected to said second arm of said first link and said second end portion connected by a second link to the extended end of said first arm of said first link; a second link having a first end connected to the second end portion of said pressure applying means and a second end connected to the extended end of said first arm of said first link and said second end extending a short distance beyond said first link; a first spring having first and second ends, said first end being connected to said housing and said second end being connected to the extended second end of said second link; means pivotally connected to said housing for bearing against the cable and causing relative movement between the cable and the apparatus to cease; means rotatably connected to the housing and responsive to the rotational velocity of the second disclike member for actuating the cable bearing means; a shaft assembly rotatably mounted to the housing and having one end connected to the actuating means and the other end connected to a first gear; a first gear mounted to said first shaft assembly; a third link having first and second end portions, a first end portion pivotally connected to a second gear and a second end portion having an elongated slot and means for attaching a second spring; a fourth link having two ends wherein one end is pivotally supported by said shaft assembly; a second gear rotatably mounted to the other end of said fourth link so as to pivot relative thereto and operatively connected to the first gear and rotatable therewith; means supported by said first arm of said first link between its extended end and its merged end for supporting said second disclike member; a third gear connected to said second disclike member and operatively connected to the second gear and rotatable therewith to transmit rotational motion from said second disclike member to said actuating means; and a second spring having first and second ends, said first end being connected to said housing and said second end being connected to the attaching means of the second end portion of said third link, said second spring biasing said third link and thereby said second and third gears together in one mode, and said third link being movable relative to said supporting means and expanding said second spring in another mode.

It is an aim of the present invention to provide an improved hoist apparatus which is simply constructed, inexpensive and reliable.

Another aspect of the present invention is to provide an improved hoist apparatus which can effectively be self treaded.

Still another object of the present invention is to provide an improved hoist apparatus which substantially reduces the likelihood of binding or jamming.

Other objects and advantages of the invention will appear from the following description taken in conjunction with the accompanying drawings.

DESCRIPTION OF THE PREFERRED EMBODIMENT

Figure 1:
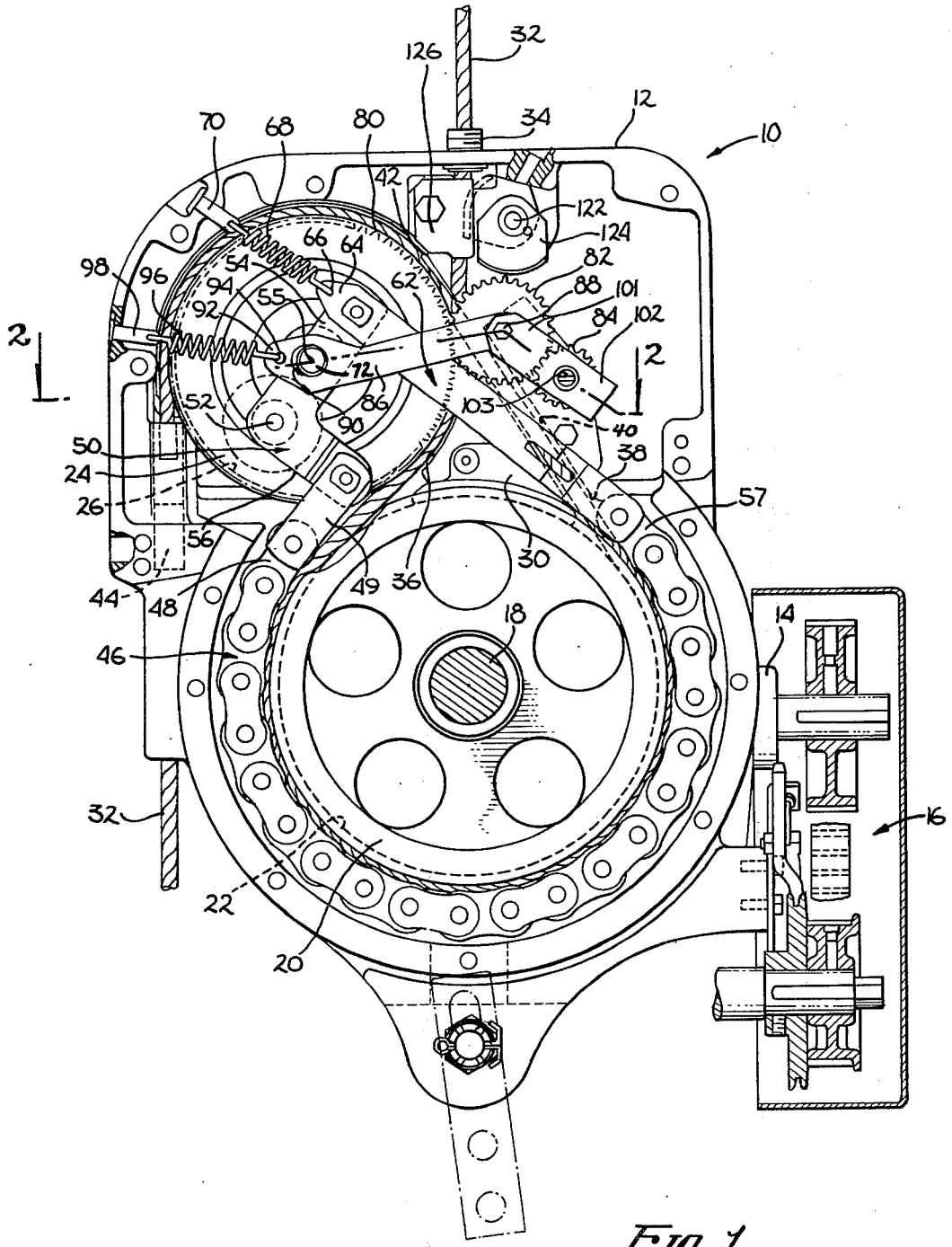
FIG. 1 is a front interior elevational view of the improved hoist apparatus.

While the present invention is susceptible of various modifications and alternative constructions, an illustrative embodiment is shown in the drawings and will herein be described in detail. It should be understood, however, that it is not the intention to limit the invention to the particular form disclosed; but on the contrary, the invention is to cover all modifications, equivalences and alternative constructions falling within the spirit and scope of the invention as expressed in the appended claims.

As mentioned hereinabove, the present invention is an improvement of the apparatus shown in U.S. Pat. No. 3,944,185. Like the hoist apparatus there, the improved hoist apparatus disclosed here is primarily used as a means for moving scaffolding upwardly and downwardly along a wire rope or cable.

Figure 2:
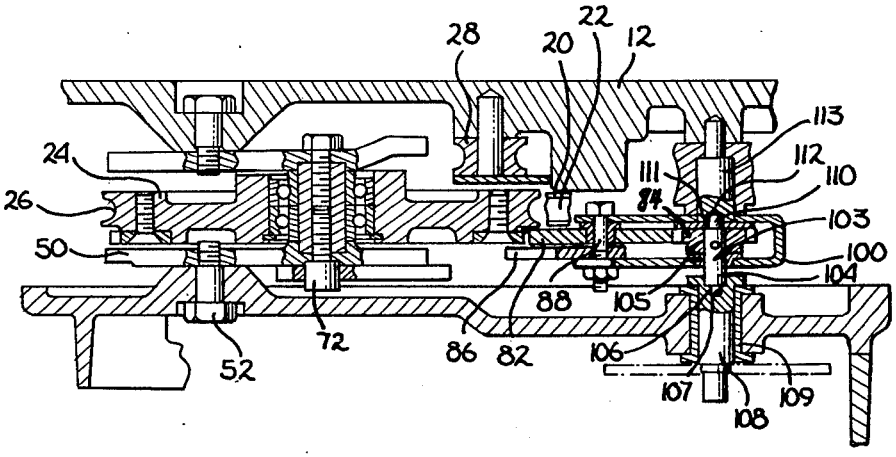
FIG. 2 is a partially broken away, enlarged plan view of the improved hoist apparatus taken along line 2—2 of FIG. 1.

An advantage of the improved hoist apparatus is that it is simply constructed, relatively inexpensive and highly reliable. Referring now to FIGS. 1 and 2, the apparatus 10 includes an outer housing 12, a motor 14, a power transmission 16, a main drive shaft 18, a first large disclike member, such as a sheave 20 having a circumferential peripheral groove 22, a second smaller disclike member such as a sheave 24 having a circumferential peripheral groove 26, a number of rollers, such as a roller 28, which also have grooved circumferential peripheries, and a diverter block 30. The groove of the sheave 20 and the groove of the sheave 24 are positioned in planar alignment while the grooves of the rollers form an arcuate path in a plane offset from the first mentioned planar alignment.

In operation, a cable 32 is received through a formed opening 34 in the upper part of the housing 12. The cable is most commonly braided wire having a 5/16 inch diameter and is commonly referred to as 6 × 19 FC or IWRC. The cable passes downwardly around a relatively small portion of the periphery of the small sheave 24 being guided to the left by an arcuate surface 36 of the diverter block 30. The cable then passes downwardly, around the large sheave 20 and upwardly through an opening 38 into an oblique passageway 40 of the diverter block. The cable then exits from an upper opening 42 in the diverter block, moves around the peripheries of the rollers 28, through a vertical passageway 44 in the housing 12 and then outwardly away from the apparatus. It can be appreciated that this simple wrapping of the cable in the manner just described allows the apparatus 10 to move upwardly and downwardly along the cable in a continuous manner. The only limit to the movement of the apparatus is the length of the cable itself.

In order for the apparatus to be effective, the cable 32 must make sufficient contact with the peripheral groove 22 of the large sheave 20 to allow relative movement of the sheave and the cable. It is of course understood that such movement is created by the friction generated between the cable and the groove's surface. Thus, when the load which the apparatus is carrying is heavy, the frictional engagement of the cable and the sheave must be substantial; when the load carried by the apparatus is light, the frictional force between the cable and the sheave may also be light. In order to increase the frictional force, the cable must press more deeply into the groove, deforming the cable but providing a greater surface area of contact between the cable and the sheave as well increasing the component of force normal to the area of contact between the cable and the groove surface.

To achieve a greater or lesser contact between the cable and the sheave, a pressure applying member is provided, such as a chain 46. Connected to a first end portion 48 of the chain by an arm 49 is a first link 50 having an "L" or bell crank shape; the link is connected to the housing by a fastener 52. It is noted that the fastener is located where the long arm 54 and the short arm 56 of the link 50 merge and that the axis of the fastener 52 is removed from the center or axis of rotation designated by the numeral 55 of the small sheave 24. The small sheave is rotatably mounted to the long arm 54 of the first link 50 at approximately its mid point by a fastener 72.

The other or second end portion 57 of the chain is connected to the extended end of the long arm 54 of the first link 50 by an elongated second link 62. The link 62 not only extends to the arm 54 but slightly beyond to form an end portion 64 within which is an opening 66. A tensioning spring 68 is placed so that one end is received in the opening 66 of the second link 62 while the other end is received by a pin 70 which is restrained by the housing 12.

It can now be appreciated that what has been described is the mechanism for varying the force acting on the cable in that region where it contacts the peripheral groove of the large sheave 20 and is accomplished as follows.

When the cable 32 is under tension, it will tend to straighten itself. Hence, as the cable passes briefly around a portion of the small sheave 24, an increase in tension in the cable will generate a force upon the sheave acting to pivot it in a counterclockwise direction (as viewed in FIG. 1) about the fastener 52. This movement will cause both of the arms 54 and 56 of the link 50 to move in a counterclockwise direction so as to tighten the chain about the cable in the peripheral groove 22 of the large sheave 20. This results in pressing the cable into the groove and increasing the frictional force between the cable and the sheave so as to prevent slippage between the sheave and the cable. In this manner, rotational movement of the large sheave is translated to vertical movement of the apparatus along the cable.

While it is desirable to exert a sufficient force upon the cable by the chain during normal operation, a countervailing consideration is important during the initial threading or reeving of the cable through the apparatus. Only a very slight frictional force is needed between the cable and the large sheave when the cable is initially threading itself since no load is being supported. A problem, however, has been recognized and solved by the present apparatus. With a prior art device a blockage or jam often occurred as the cable moved to the diverter block. If the cable did not properly enter the block, a jam occurred because of the high frictional force between the cable and the large sheave; the cable would be pushed into abutment with the diverter block and would begin to unravel or "bird cage". As the bird caging continued, the various strands of the wire rope would intertwine itself with the various mechanisms of the apparatus. Not only did this defeat the advantage of self reeving, but required the time and accompanying expense of an operator to remove the damaged portion of the cable, cut the cable at a place where it had not unraveled and rethread the cable through the apparatus. In addition, if the cable had damaged any of the mechanisms within the apparatus, then these would have to be repaired or replaced.

A major advantage of the present apparatus is the manner in which a force is applied to the cable by the chain during the self-threading process. Normally, there would be no tension in the cable during the self-threading operation so that no biasing force is placed on the small sheave causing it to rotate in a counterclockwise direction. (By the same token there would be no force acting on the cable as it passes around the large sheave, unless such a force is built into the system.) The spring 68 provides a light pull on the chain and thus a light force acting on the cable sufficient to allow it to be pushed through the apparatus for self-threading purposes, but not sufficient should the end of the cable abut the diverting block. Under such normal threading, the cable needs approximately 20 pounds of force to proceed through the apparatus. However, if an abutment occurs, the small force supplied by the spring will be insufficient to move the cable; the frictional force between the sheave and the cable will not be enough to transfer the motion from the sheave to the cable. When this happens there will be relative movement or slippage. If abutment occurs no jam or damage takes place. The operator merely reverses the sheave, stops and tries again. Thus, what has been achieved is a very simple, inexpensive but reliable method to enable the apparatus to be self-threaded without any offsetting detriment to the main operation of the apparatus.

A more important advantage of the apparatus disclosed herein will be appreciated by referring once again to FIGS. 1 and 2. The apparatus also includes three gears, a large gear 80, a middle size gear 82 and a small gear 84 for transferring motion from the small sheave 24 to a safety brake apparatus which will be described in more detail hereinbelow. The large gear 80 is attached to the small sheave 24 and rotates with it about the fastener 72. Also mounted to the fastener 72 is a third link 86, one end of which supports a fastener 88 which in turn mounts the middle gear 82. The other end of the third link 86 has a slot 90 within which receives the fastener 72, but which allows the third link 86 to move in a direction generally parallel to its longitudinal axis. Extending outwardly from the slot and opposite the end supporting the gear 82 is an end portion 92 of the link which includes an opening 94. A spring 96 has one end received by the opening 94 while the other end is attached to a pin 98 which in turn is restrained by the housing 12. The spring is made of high carbon steel wire (often called music wire) having a 0.080 inch diameter and formed into a coil having a 0.48 inch diameter. The spring rate is 70 pounds per inch, has an "at rest" or untensioned length of about 1.91 inches, an initial tensioned length of about 2.3 inches (the condition shown in FIG. 1) and a fully extended or tensioned length of 2.6 inches. The initial tension in the spring is approximately 7 pounds so that at the initial tensioned length, there is a brasing force of about 35 pounds.

Also attached to the fastener 88 is a fourth link 100 having a first end portion 101 connected to the fastener 88 and a second end portion 102 fastened to a shaft assembly 103 to which the small gear 84 is also mounted. Each of the links are pivotal about each of their mountings; this is, the third link 86 can pivot about the fastener 72 as well as about the fastener 88 while the fourth link 100 can pivot about the fastener 88 and the shaft assembly 103. As can now be appreciated the middle gear 82 "floats" between the large gear and the small gear in response to the pivoting of the third link 86 and the fourth link 100. This is necessary in order to respond to the pivoting movement of the small sheave which in turn moves in response to the tensioning of the cable.

The floating gear mechanism as used in prior art devices were found to jam or bind when forces acting on the linkage were transferred to the gears. For example, the actuation of the brake mechanism under emergency conditions, or contamination or rough handling might cause the fourth link to pull the third link. The effect of this was to bind the shaft on which the small gear was mounted in its bearing. The gears might also strip themselves. Furthermore, this pull on the third link in turn pulled or pivoted the small sheave and thereby lessened the tension on the chain. As explained earlier lessening the tension on the chain lessened the frictional engagement of the large sheave and the cable causing the device to lose its ability to effectively operate.

The above-mentioned problems have been solved in a very simply, inexpensive and yet reliable manner by providing the spring 96 and the slot 90 in the link 86. Should excessive forces appear, the fourth link 100 would rotate clockwise as viewed in FIG. 1. This would cause a pull upon the third link 86. However, instead of pulling the first link 50, the link 86 merely moves rightwardly due to the slot and against the biasing force of the spring 96. There is protection against stripping the gears because the middle gear 82 will disengage from the large gear 80. Furthermore, since there is no tendency to pivot the small sheave 24 in a clockwise direction, the force upon the cable will not be lessened and the cable will remain in proper engagement with the large sheave.

To prevent damage to the small gear shaft, reference is made to the shaft assembly 103, shown in FIG. 2. The assembly includes a center shaft 104 rotatably mounted in a bushing 105. An end 106 of the shaft is flattened and is received by an opening 107 having a complimentary shape in a second shaft 108 which is mounted in a bushing 109. The opposite end 110 of the center shaft is rotatably received by a bushing 111 in an opening 112 of a third shaft 113. The center shaft rotates with the small gear as does the second shaft 108. The mating engagement of the ends 106, 107 allows the apparatus to be opened without requiring the shaft to be disassembled. In addition, some of the non rotational forces are relieved by the larger second shaft 108 and its large bushing 109. More importantly is the engagement between the center shaft 104 and the third shaft 113. The third shaft 113 is fixedly attached to the fourth link 100 and pivots with it but does not rotate with the center shaft 104. This arrangement separates the rotating forces acting on the gear from the lateral forces acting upon the link 100. For example, when excess forces act upon the link 100 they are transferred to the shaft 113 instead of a shaft which also rotates.

Figure 4:
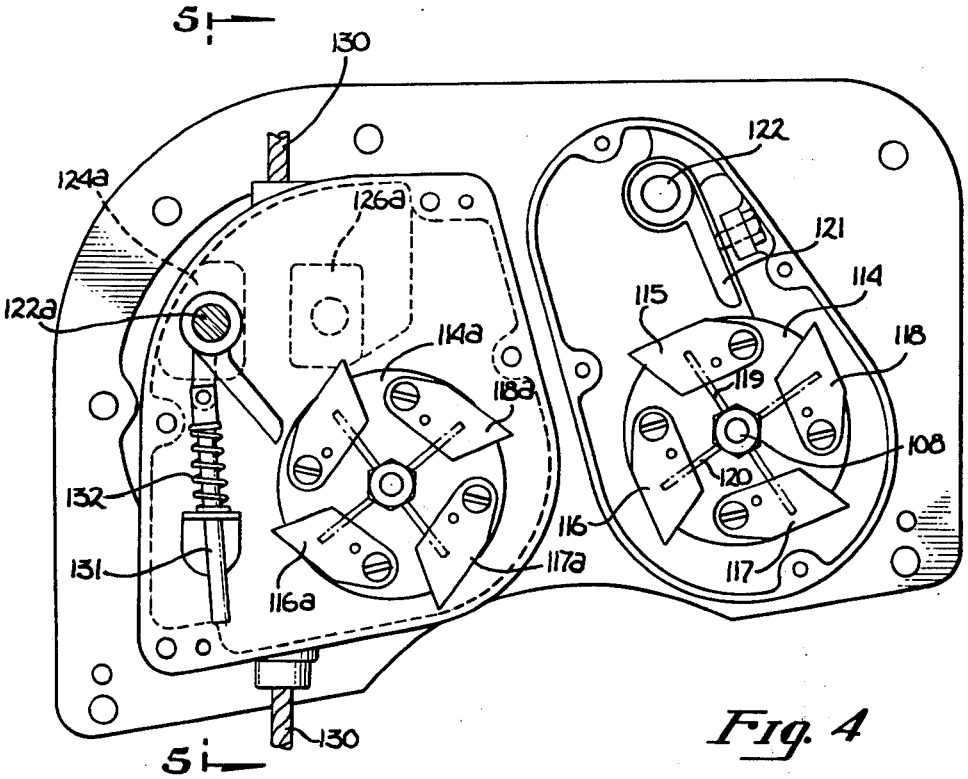
FIG. 4 is a back interior elevational view of safety brake mechanisms for the apparatus.
Figure 5:
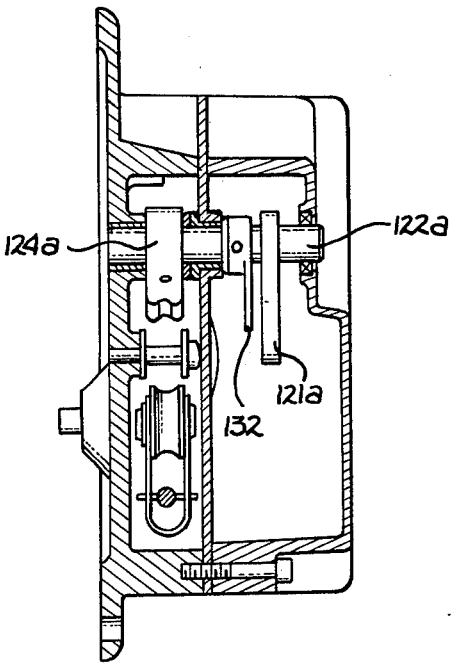
FIG. 5 is an elevational view taken along line 5—5 of FIG. 4.

Referring now to FIGS. 4 and 5 there is illustrated the safety brakes of the apparatus. The brakes include brake actuating means including a round plate 114 attached to the shaft 108 which will rotate in response to the velocity imparted to the shaft 108 by the small gear 84. Mounted to the plate 114 are four pivotal pawls 115, 116, 117 and 118 disposed in pairs, by springs 119 and 120. When rotation of the plate 114 exceeds a predetermined velocity, the centrifugal force generated will pivot the pawls outwardly against the resistance of two springs 119 and 120. A pawl will bear upon a lever 121 which is spring loaded (not shown but identical to that described hereinbelow relating to a spring 132 and corresponding to snap pivot in a clockwise direction. The movemet of the lever causes a shaft 122, FIG. 1 to rotate. A cam 124 also mounted to the shaft rotates in a clockwise direction wedging the cable 32 between itself and a block 126. This acts as a positive lock on the cable which in turn locks the apparatus to the cable. A second similarly constructed saftey brake is provided to work in conjunction with a special safety cable 130. As can be seen in FIG. 4 an identical plate **114*a* is provided having pawls 115*a*, 116*a*, 117*a*, 118*a* which are paired and restrained by the springs 119*a* and 120*a*** in a manner identical to that described above for the similarly numbered mechanism.

The pawls operate on a lever **121*a* which in turn is mounted to a shaft 122*a* to which is also mounted a cam 124*a*, FIG. 5. As can be seen in FIG. 4, the lever 121*a* is spring biased having a shaft 131 about which is a spring 132. When there is a slight force acting on the lever 121*a*, a slight rotational movement will cause the shaft 131 and a link 132 connected to the shaft 122*a* causing the shaft 122*a* to be rotated in a snapping forceful manner so as to wedge the cable 130 between the cam 124*a* and a block 126*a*. Because of the spring loading and its effect on the rotating shaft 122 and 122*a*, and because of the relatively large number of pawls operating on the rotating discs 114 and 114*a* the cams will be immediately actuated upon the rotation of these plates exceeding a predetermined velocity. In the case of the plate 114 a rotational velocity greater than 50 feet per second will activate the cam 124 while in the case of the plate 114*a* a velocity of 100 feet per second will activate the cam 124*a***.

Figure 3:
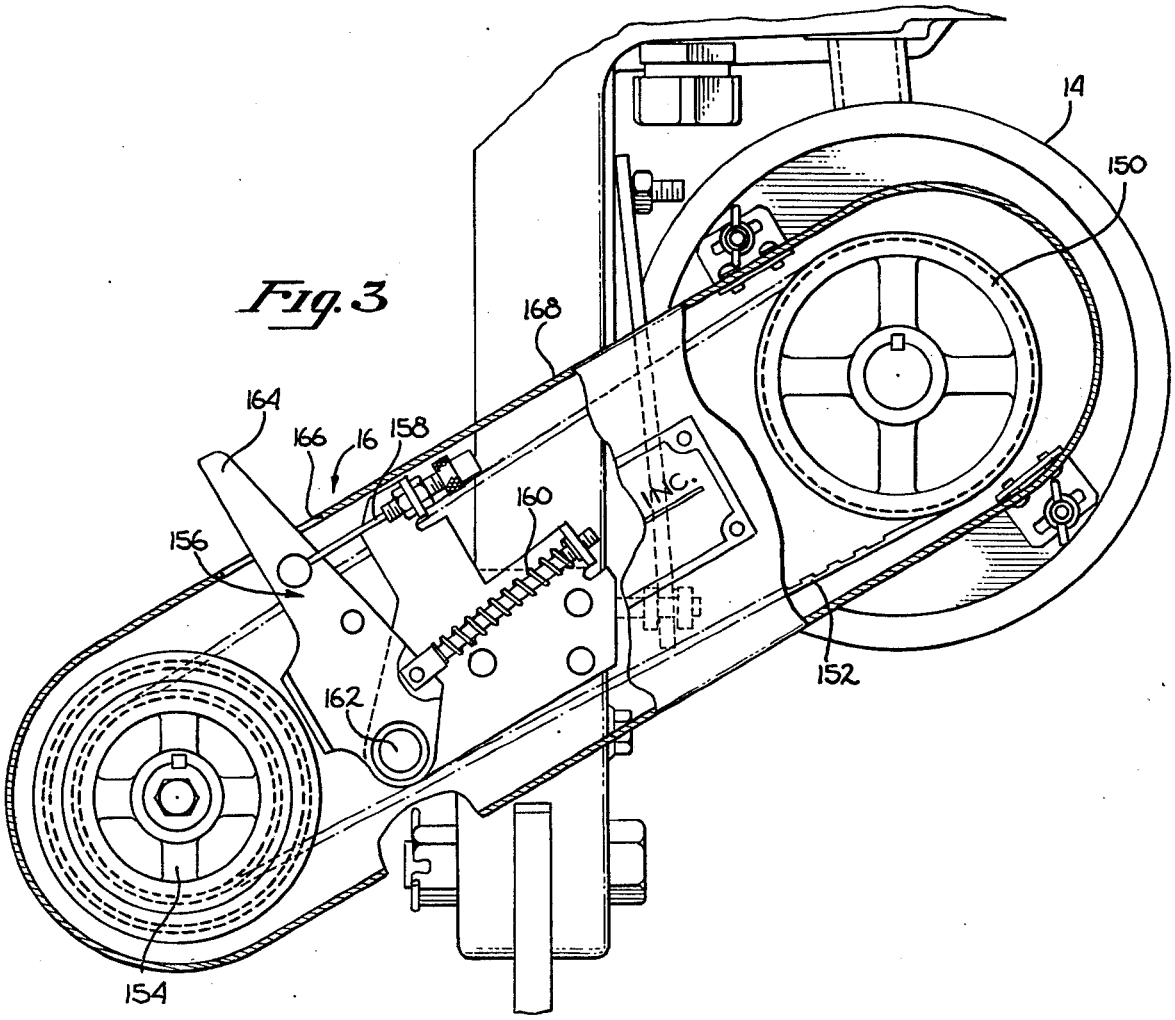
FIG. 3 is a partially broken away elevational view of the transmission of the apparatus.

Reference is now made to FIG. 3 which illustrates the power transmission 16 including a driving pulley 150 attached to the motor 14 for rotating a belt 152 that in turn rotates a driven pulley 154. Power is eventually transferred to the main drive shaft 18, FIG. 1. Operative with the transmission is a primary brake mechanism for the apparatus. The brake includes a brake shoe 156, a solenoid actuated wire 158, a biasing spring 160 and a fastener 162 about which the brake shoe pivots. The solenoid (not shown) retains the brake shoe in a disengaged position, i.e. pivoted about the fastener 162 to its rightward position (as viewed in FIG. 3). However, when the apparatus is stationary (not moving upwardly or downwardly) or when the source of power is disrupted, the solenoid will deactivate causing the brake shoe 156 to pivot counterclockwise against the driven pulley 154 in response to the biasing spring 160. This of course will act as a brake upon the driven pulley causing it to remain stationary. The brake shoe also includes an upstanding projection 164 which extends through an opening 166 in the transmission cover 168 so that the brake shoe may be operated manually. Once again, a simple yet effective and reliable mechanism has been disclosed which provides for the safety of the apparatus.

What is claimed is:

1. An improved hoist apparatus for moving along a cable comprising;

a housing;

a first disclike member mounted to said housing and having a circumferential peripheral groove receiving a cable;

a first link having first and second arms in a generally L-shape, said link being pivotally connected to said housing where the two arms merge;

a second disclike member rotatably mounted to said first link at a mid portion of said first arm for allowing said second disclike member to pivot toward and away from said first disclike member, said second disclike member having a circumferential peripheral groove in planar alignment with the periphery of said first disclike member;

roller means having peripheral grooves disposed adjacent said second disclike member for directing said cable away from said first disclike member and then out of said housing;

pressure applying means disposed about said first disclike member for biasing said cable toward the peripheral groove of said first member, said pressure applying means having first and second end portions, said first end portion being connected to said second arm of said first link and said second end portion connected by a second link to the extended end of said first arm of said first link;

a second link having a first end connected to the second end portion of said pressure applying means and a second end connected to the extended end of said first arm of said first link, and said second end extending a short distance beyond said first link;

a first spring having first and second ends, said first end being connected to said housing and said second end being connected to the extended second end of said second link;

means pivotally connected to said housing for bearing against the cable and causing relative movement between the cable and the apparatus to cease;

means rotatably connected to the housing and responsive to the rotational velocity of the second disclike member for actuating the cable bearing means;

a shaft assembly rotatably mounted to the housing and having one end connected to the actuating means and the other end connected to a first gear;

a first gear mounted to said first shaft assembly;

a third link having first and second end portions, a first end portion pivotally connected to a second gear and a second end portion having an elongated slot and means for attaching a second spring;

a fourth link having two ends wherein one end is pivotally supported by said shaft assembly;

a second gear rotatably mounted to the other end of said fourth link so as to pivot relative thereto and operatively connected to the first gear and rotatable therewith;

means supported by said first arm of said first link between its extended end and its merged end for supporting said second disclike member;

a third gear connected to said second disclike member and operatively connected to the second gear and rotatable therewith to transmit rotational motion from said second disclike member to said actuating means; and a second spring having first and second ends, said first end being connected to said housing, and said second end being connected to the attaching means of the second end portion of said third link, said second spring biasing said third link and thereby said second and third gears together when in one mode, and said third link being movable relative to said supporting means and expanding said second spring when in another mode.

2. An apparatus as claimed in claim 1 wherein said actuating means includes a round plate, first and second sets of pawls, each set having two oppositely disposed pivotal pawls connected by a spring, said pawls being movable in response to centrifugal forces caused by rotation of said plate.

3. An apparatus as claimed in claim 1; including a motor connected to said housing;

means for transmitting motion from said motor to said first disclike member through a pulley;

means for selectively bearing against said pulley, said bearing means being pivotally connected to the housing and having a portion extending away from the housing for manual operation, said bearing means being spring biased.

4. An apparatus as claimed in claim 1 wherein said shaft assembly includes a center shaft having first and second ends for mounting said first gear, a second shaft engaging said first end of said center shaft, and a third pivotal, but nonrotatable shaft connected to the second end of said center shaft.

* * * * *